US011859519B2

(12) United States Patent
Sheren et al.

(10) Patent No.: US 11,859,519 B2
(45) Date of Patent: Jan. 2, 2024

(54) LASH SETTING FEATURES FOR CASTELLATION MECHANISM

(71) Applicant: Eaton Intelligent Power Limited, Dublin (IE)

(72) Inventors: James R. Sheren, Grand Ledge, MI (US); Andrei Radulescu, Marshall, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/852,789

(22) Filed: Jun. 29, 2022

(65) Prior Publication Data

US 2023/0287810 A1 Sep. 14, 2023

Related U.S. Application Data

(63) Continuation of application No. PCT/EP2021/025008, filed on Jan. 14, 2021.
(Continued)

(51) Int. Cl.
*F01L 13/06* (2006.01)
*F01L 1/18* (2006.01)

(52) U.S. Cl.
CPC ..... *F01L 13/065* (2013.01); *F01L 1/181* (2013.01); *F01L 2303/01* (2020.05)

(58) Field of Classification Search
CPC ..... F01L 13/065; F01L 2303/01; F01L 1/20; F01L 1/181
(Continued)

(56) References Cited

U.S. PATENT DOCUMENTS 4,384,558 A 5/1983 Johnson
2010/0024767 A1 2/2010 Meneely et al.
(Continued)

FOREIGN PATENT DOCUMENTS

CN 105089733 A 11/2015
CN 105899770 A 8/2016
(Continued)

OTHER PUBLICATIONS

International Search Report and Written Opinion for International Application No. PCT/EP2021/025008 dated May 4, 2021.

*Primary Examiner* — Phutthiwat Wongwian
*Assistant Examiner* — Arnold Castro
(74) *Attorney, Agent, or Firm* — Pearne & Gordon LLP

(57) ABSTRACT

An engine brake rocker arm assembly for a valvetrain and operable in an engine drive mode and an engine braking mode. The assembly is configured to selectively open one of first and second exhaust valves in the engine braking mode and includes a brake rocker arm configured to rotate about a rocker shaft, and an engine brake capsule assembly movable between (i) a locked position configured to perform an engine braking operation, and (ii) an unlocked position that does not perform the engine braking operation. A lash setting tool is configured to removably engage the engine brake capsule assembly and move the engine brake capsule to the locked position to enable mechanical lash adjustment while the brake rocker arm is assembled in a valvetrain and the engine brake capsule is assembled in the brake rocker arm.

20 Claims, 4 Drawing Sheets

Related U.S. Application Data

(60) Provisional application No. 62/961,273, filed on Jan. 15, 2020.

(58) Field of Classification Search
USPC ..... 123/231
See application file for complete search history.

(56) References Cited

U.S. PATENT DOCUMENTS

| | | | | |
|---|---|---|---|---|
| 2012/0131808 | A1* | 5/2012 | Spencer | F01L 1/20 33/611 |
| 2014/0251266 | A1 | 9/2014 | Emmons et al. | |
| 2015/0144096 | A1* | 5/2015 | Meneely | F01L 1/181 123/321 |
| 2018/0187579 | A1 | 7/2018 | Cecur | |
| 2018/0334930 | A1 | 11/2018 | Hattiangadi et al. | |
| 2020/0325803 | A1* | 10/2020 | Patil | F01L 1/181 |

FOREIGN PATENT DOCUMENTS

| | | | |
|---|---|---|---|
| CN | 107771242 | A | 3/2018 |
| CN | 108952872 | A | 12/2018 |
| CN | 110425016 | A | 11/2019 |
| WO | 2015177127 | A1 | 11/2015 |
| WO | 2016207348 | A1 | 12/2016 |
| WO | 2018/034749 | A1 | 2/2018 |
| WO | 2019036272 | A1 | 2/2019 |
| WO | 2019133658 | A1 | 7/2019 |

* cited by examiner

LASH SETTING FEATURES FOR CASTELLATION MECHANISM

CROSS-REFERENCE TO RELATED APPLICATIONS

This application is a continuation of International Application No. PCT/EP2021/025008 filed Jan. 14, 2021, which claims the benefit of U.S. Provisional App. No. 62/961,273, filed on Jan. 15, 2020. The disclosure of the above application is incorporated herein by reference.

FIELD

The present disclosure relates generally to a rocker arm assembly for use in a valve train assembly and, more particularly, to a rocker arm assembly with lash setting features for an engine brake capsule.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly. However, it may be difficult to set the lash for the rocker arm utilized for the compression engine braking, particularly when packaging space is at a minimum. Accordingly, it is desirable to provide improvements in the art.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one example aspect, an engine brake rocker arm assembly for a valvetrain and operable in an engine drive mode and an engine braking mode is provided. The engine brake rocker arm assembly is configured to selectively open one of first and second exhaust valves in the engine braking mode and includes a brake rocker arm configured to rotate about a rocker shaft, and an engine brake capsule assembly movable between (i) a locked position configured to perform an engine braking operation, and (ii) an unlocked position that does not perform the engine braking operation. An actuator assembly is configured to selectively move the engine brake capsule assembly between the first and second positions. A lash setting tool is configured to removably engage the engine brake capsule assembly and move the engine brake capsule to the locked position to enable mechanical lash adjustment while the brake rocker arm is assembled in a valvetrain and the engine brake capsule is assembled in the brake rocker arm.

In addition to the foregoing, the described engine brake rocker arm assembly may include one or more of the following features: wherein the lash setting tool is configured to be inserted into a bore formed in the brake rocker arm to engage the engine brake capsule; wherein the lash setting tool includes a cylindrical body having a grasping end and a keyed insertion end; and wherein the keyed insertion end is keyed to an actuator pin such that the keyed end is configured to be inserted into a recess formed in an end of the actuator pin, turned, and then pulled to thereby pull the actuator pin to cause the engine brake capsule assembly to move to the locked position to enable the mechanical lash adjustment.

In addition to the foregoing, the described engine brake rocker arm assembly may include one or more of the following features: wherein the engine brake capsule assembly comprises a first castellation member, a second castellation member, and a castellation biasing member that biases the first and second castellation members apart; wherein the first castellation member comprises a series of first teeth and first valleys, and wherein the second castellation member comprises a series of second teeth and second valleys; and wherein the first teeth and second teeth have the same width.

In addition to the foregoing, the described engine brake rocker arm assembly may include one or more of the following features: wherein the first series of teeth oppose the second series of teeth in the locked position during the engine brake mode, and wherein the second series of teeth align with the first valleys in the unlocked position during the engine drive mode; wherein the first castellation member rotates relative to the second castellation member when moving from the unlocked position to the locked position; wherein the first and second castellation members are configured to collapse toward each other during the unlocked position; and wherein the actuator assembly comprises an actuator pin slidingly disposed within a bore formed in the brake rocker arm, wherein a hydraulic chamber is defined in the bore adjacent the actuator pin.

In addition to the foregoing, the described engine brake rocker arm assembly may include one or more of the following features: wherein the hydraulic chamber is fluidly coupled to a source of hydraulic fluid to selectively move the actuator pin between a first position that corresponds to the engine brake capsule assembly locked position, and a second position that corresponds to the engine brake capsule assembly unlocked position; wherein the actuator assembly further comprises a retainer disposed in one end of the bore, and the actuator pin extends at least partially through the retainer; and wherein the actuator pin includes a first seal, a second seal, and an annular flange, wherein the annular flange is configured to be received within a slot formed in the engine brake capsule assembly, wherein translation of the actuator pin in the bore translates the annular flange to thereby rotate a first castellation member of the engine brake capsule assembly.

In addition to the foregoing, the described engine brake rocker arm assembly may include one or more of the following features: wherein the engine brake capsule assembly is disposed within a bore formed in the brake rocker arm and includes a retainer, a lash adjustment screw, a first castellation member, a second castellation member operatively associated with the first castellation member, a castellation shaft extending through the retainer, the lash adjustment screw, and the first and second castellation members, and a castellation biasing mechanism disposed between the first and second castellation members and configured to bias the first and second castellation members apart; and wherein the engine brake capsule assembly further comprises a castellation nut coupled to the lash adjustment screw, and wherein the castellation shaft is configured to slide within the lash adjustment screw.

In another example aspect, a valvetrain assembly is provided. In the example embodiment, the valvetrain includes a first engine valve, a second engine valve, a valve bridge operatively associated with the first and second engine valves, and an engine brake rocker arm assembly including a brake rocker arm configured to rotate about a rocker shaft, and an engine brake capsule assembly movable between (i) a locked position configured to open one of the first and second engine valves and perform an engine braking operation, and (ii) an unlocked position that does not perform the engine braking operation. An actuator assembly is configured to selectively move the engine brake capsule assembly between the first and second positions. A lash setting tool is configured to removably engage the engine brake capsule assembly and move the engine brake capsule to the locked position to enable mechanical lash adjustment while the brake rocker arm is assembled in a valvetrain and the engine brake capsule is assembled in the brake rocker arm.

In addition to the foregoing, the described valvetrain assembly may include one or more of the following features: an exhaust rocker arm assembly having an exhaust rocker arm configured to rotate about the rocker shaft and selectively engage the valve bridge to open the first and second engine valves; and wherein the lash setting tool is configured to be inserted into a bore formed in the brake rocker arm to engage the engine brake capsule.

BRIEF DESCRIPTION OF THE DRAWINGS

The present disclosure will become more fully understood from the detailed description and the accompanying drawings, wherein.

DETAILED DESCRIPTION

Heavy duty (HD) diesel engines require high braking power, in particular at low engine speed. Some HD diesel engines are configured with valvetrains having a valve bridge and include with single overhead cam (SOHO) and overhead valve (OHV) valvetrain. The present disclosure provides high braking power without applying high load on the rest of the valvetrain (particularly the pushrod and camshaft). In this regard, the present disclosure provides a configuration that opens only one exhaust valve during a braking event.

Figure 1:
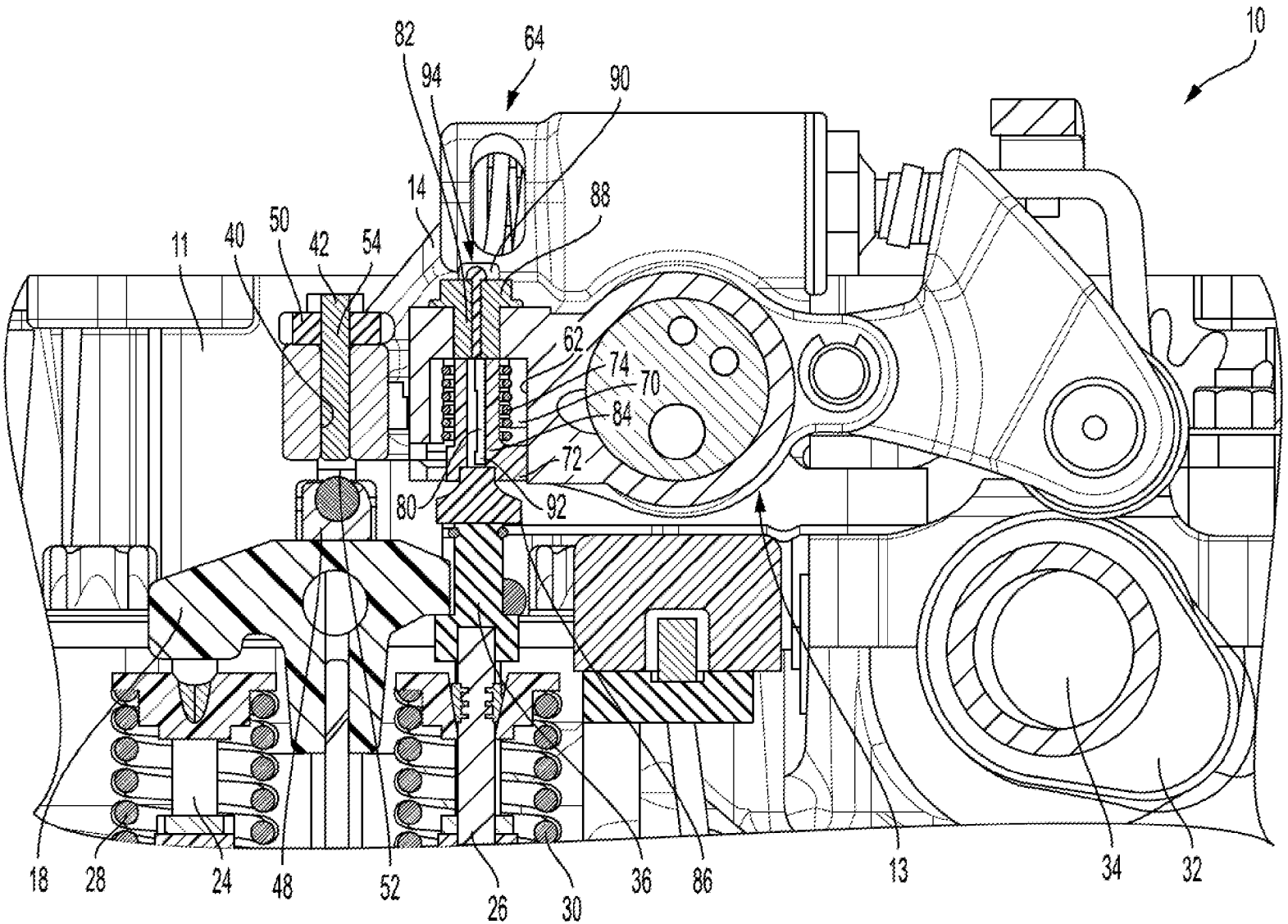
FIG. 1 is a sectional view of an example partial valve train assembly including an exhaust rocker arm assembly constructed in accordance to one example of the present disclosure and shown cooperating with a valve bridge and first and second exhaust valves.

With initial reference to FIG. 1, a partial valvetrain assembly constructed in accordance to one example of the present disclosure is shown and generally identified at reference 10. The partial valve train assembly 10 utilizes engine braking and is shown configured for use in a six-cylinder engine. It will be appreciated however that the present teachings are not so limited. In this regard, the present disclosure may be used in any valve train assembly that utilizes engine braking.

The partial valve train assembly 10 is supported in a valve train carrier 11 and can include two or more rocker arm assemblies per cylinder. In the example embodiment, each cylinder includes an intake valve rocker arm assembly (not shown), an exhaust valve rocker arm assembly 12, and an engine brake rocker arm assembly 13. The intake valve rocker arm assembly is configured to control motion of intake valves of an associated engine (not shown).

In the example embodiment, the exhaust valve rocker arm assembly 12 is configured to control opening of exhaust valves of the engine, and engine brake rocker arm assembly 13 incorporates integrated engine brake functionality. In general, the exhaust valve rocker arm assembly 12 is configured to control exhaust valve motion in a combustion engine drive mode, and the engine brake rocker arm assembly 13 is configured to act on one of the two exhaust valves in an engine brake mode, as will be described herein in more detail.

In the illustrated embodiment, the exhaust valve rocker arm assembly 12 can generally include an exhaust rocker arm 14 that rotates about a rocker shaft 16 and selectively engages a valve bridge 18. The engine brake rocker arm assembly 13 can generally include a brake rocker arm 20 having an engine brake capsule assembly 22. In the example embodiment, the valve bridge 18 is configured to engage first and second exhaust valves 24, 26 associated with a cylinder of the engine. In the illustrated example, the first exhaust valve 24 is a non-braking exhaust valve that is biased by a valve spring 28, and the second exhaust valve 26 is a braking exhaust valve that is biased by a valve spring 30. The exhaust rocker arm 14 rotates around the rocker shaft 16 based on a lift profile 32 of a cam shaft 34, as described herein in more detail, and a pass through pin 36 is positioned on the valve bridge 18 to enable actuation of exhaust valve 26 without actuation of valve bridge 18 or first exhaust valve 24.

In the illustrated example, exhaust rocker arm 14 includes an end having a bore 40, a mechanical lash adjusting shaft 42, an e-foot 48, and a nut 50. The shaft 42 includes a first end 52 and an opposite second end 54 and extends through bore 40. The e-foot 48 is coupled to or operably associated with the shaft first end 52, and the nut 50 is threadably secured to the shaft second end 54. The valve lash set at a central contact point of the bridge 18 may be adjusted by way of shaft 42 and nut 50. In this regard, the nut 50 can be adjusted (e.g., rotated) to provide a desired lash setting between the e-foot 48 and the valve bridge 18. Other configurations may be used.

Figures 2A, 2B, 2C:
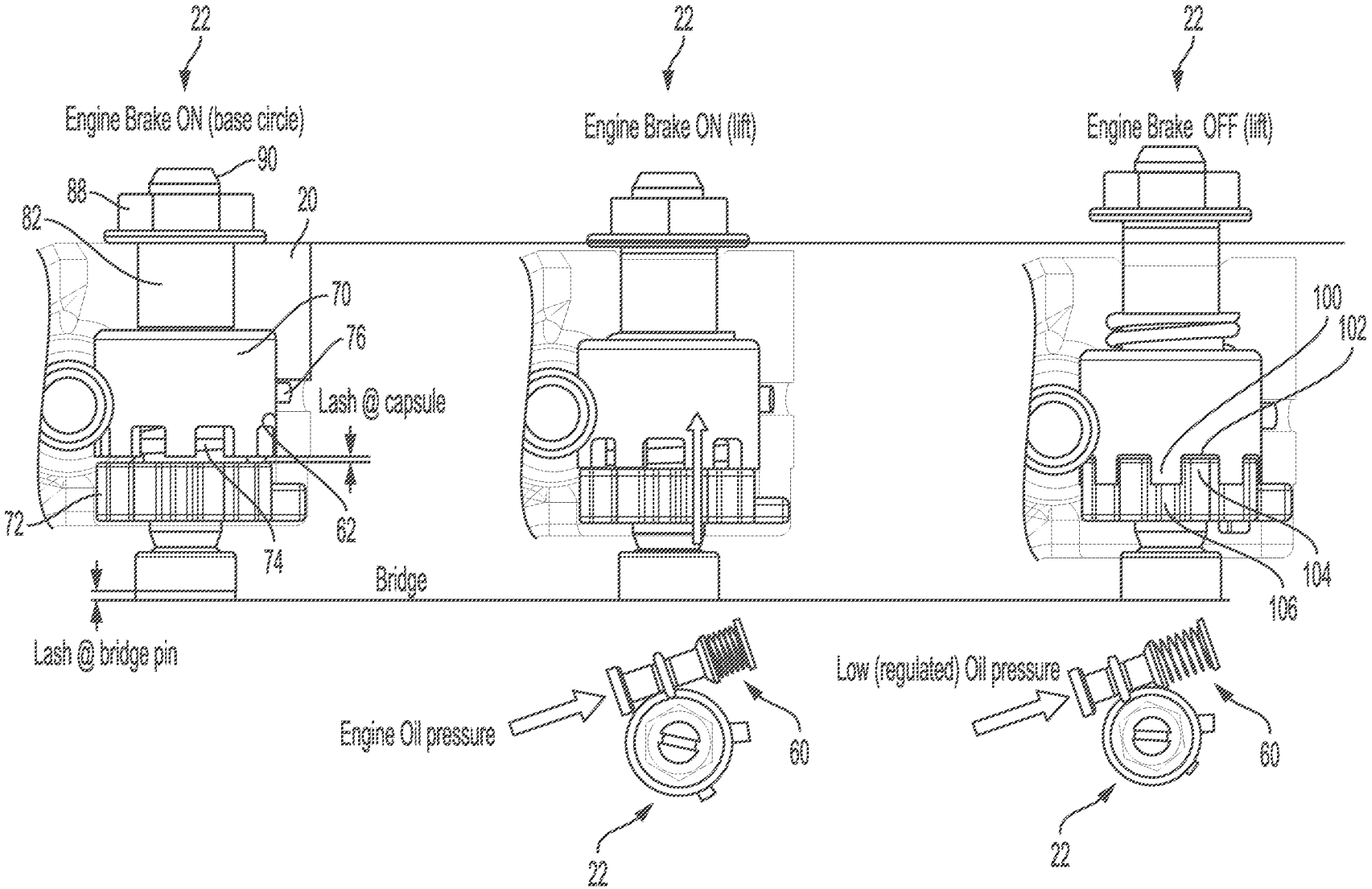
FIG. 2A is a side view of an example engine brake capsule and actuator assembly of the exhaust rocker arm assembly shown in FIG. 1 on base circle in an engine braking mode.
FIG. 2B is a side view of the engine brake capsule and actuator assembly of FIG. 2A during lift in the engine braking mode.
FIG. 2C is a side view of the engine brake capsule and actuator assembly of FIG. 2A in a normal drive mode.

With additional reference to FIG. 2, in the example embodiment, the engine brake capsule assembly 22 is operably associated with an actuator assembly 60. As will become appreciated from the following discussion, the actuator assembly 60 is hydraulically controlled between a first position (FIG. 2B) and a second position (FIG. 2C) to mechanically move the engine brake capsule assembly 22 between a respective latched or locked position and an unlatched or unlocked position. Notably, the actuator assembly 60 fluidly segregates the engine brake capsule assembly 22 from a source of hydraulic fluid. The intermediate placement of the hydraulic actuator assembly 60 between the selectively lockable engine brake capsule assembly 22 and the source of hydraulic fluid eliminates limitations associated with a fully mechanical actuator.

With continued reference to FIGS. 1 and 2, in the illustrated example, the engine brake capsule assembly 22 is at least partially disposed within a bore 62 formed in the brake rocker arm 20 and generally includes a mechanical lash adjuster assembly 64, a first castellation member 70, a second castellation member 72, and a castellation biasing member 74. An anti-rotation mechanism 76 (FIG. 2) such as a screw extends at least partially through the rocker arm 14 and is configured to facilitate preventing rotation of the engine brake capsule assembly 22 within the bore 62.

The mechanical lash adjuster assembly 64 generally includes a castellation shaft 80, a lash adjustment screw 82, a retainer 84, an e-foot 86, a castellation nut 88, and a stop screw and washer 90. The castellation shaft 80 includes a first end 92 and an opposite second end 94 and extends through the lash adjustment screw 82 and the retainer 84, which are disposed at least partially within the rocker arm bore 62. Moreover, the castellation shaft 80 can be configured to slide within lash adjustment screw 82. The e-foot 86 is coupled to or operably associated with the castellation shaft first end 92, and stop screw and washer 90 can be threadably secured to an inner bore formed in the castellation shaft second end 94. The castellation nut 88 is threadably secured to the lash adjustment screw 82. The valve lash set at a contact point of the bridge 18 may be adjusted by way of lash adjustment screw 82 and castellation nut 88.

As shown in FIG. 2, in the example embodiment, the first castellation member 70 can be a cup-like castellated capsule body having a series of first teeth 100 and first valleys 102, and the second castellation member 72 can be a cup-like castellated capsule body having a series of second teeth 104 and second valleys 106. As described herein in more detail, the castellation members 70, 72 can be positioned in the locked position (FIG. 2B) where the first and second teeth 100, 104 engage each other, or in the unlocked position (FIG. 2C) where the first and second teeth 100, 104 are respectively received within the second and first valleys 106, 102. As shown in FIG. 1, the castellation biasing member 74 can be disposed between the second castellation member 72 and the first castellation member 70 and is configured to bias the first and second castellation members 70, 72 apart from each other.

With additional reference to FIGS. 3-5, the actuator assembly 60 will be described in more detail. The actuator assembly 60 is configured to rotate the first castellation member 70 relative to the second castellation member 72 to switch the engine brake capsule assembly 22 between the brake active, locked position (FIG. 2B) and the brake inactive, unlocked position (FIG. 2C). In the example embodiment, the actuator assembly 60 generally includes a plunger or actuator pin 110, a retainer 112, and a pin return mechanism 114 (e.g., a spring). While the actuator pin 110 is described herein as hydraulically actuated, it will be appreciated that actuator pin 110 may be actuated by other means such as, for example, electric, pneumatic, and/or electromagnetic.

Figure 5:
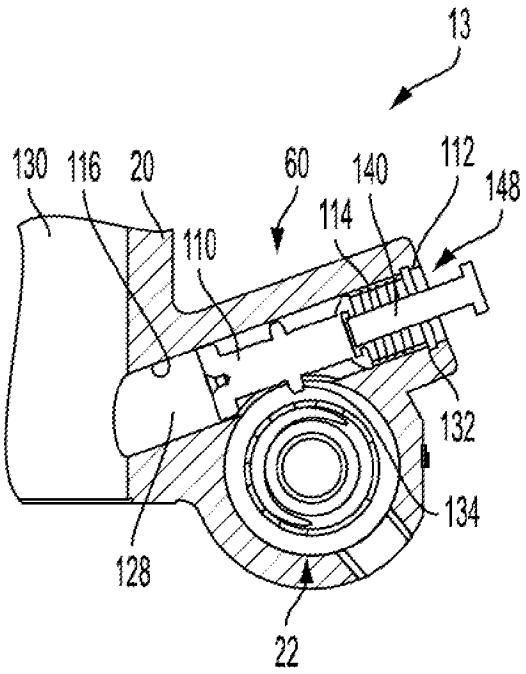
FIG. 5 is a cross-sectional view of the lash setting tool of FIG. 4 operably and removably coupled to the actuator pin of FIG. 3.

As shown in FIG. 5, the actuator pin 110 is configured to translate within a chamber or bore 116 formed in the rocker arm 20 and generally includes a first end 118, an opposite second end 120, a first seal 122, a second seal 124, and an annular flange 126. The first end 118 includes the first seal 122 and at least partially defines a hydraulic chamber 128 adjacent to the actuator pin 110 that defines a portion of the bore 116. The hydraulic chamber 128 can be fluidly coupled to a source of hydraulic fluid, for example, via a fluid port 130 formed in the brake rocker arm 20. The second end 120 is received within retainer 112 and includes the second seal 124. The pin return mechanism 114 is disposed at least partially within a seat 132 formed in the retainer 112 and is configured to bias the actuator pin 110 into the unlocked position (FIG. 2C).

In the example embodiment, the annular flange 126 is received within a slot 134 formed in the first castellation member 70. However, it will be appreciated that in alternative arrangements, the annular flange 126 can be received within a slot formed in the second castellation member 72. In the example shown, the actuator pin 110 can actuate as a result of high pressure fluid entering the hydraulic chamber 128 behind the actuator pin 110, thereby translating actuator pin 110 within bore 116. This causes rotational movement of the first castellation member 70, as described herein in more detail. In some examples, the fluid can be pressurized engine oil or other hydraulic fluid.

As discussed, the engine brake capsule assembly 22 is movable between the brake inactive (unlocked) position and the brake active (locked) position by the actuator assembly 60. In the unlocked, brake inactive position (FIG. 2C), the second teeth 104 of second castellation member 72 are aligned with the first valleys 102 of the first castellation member 70, and the first teeth 100 of the first castellation member 70 are aligned with the second valleys 106 of the second castellation member 72 such that the second castellation member 72 slides inside the first castellation member 70 and the engine brake capsule assembly 22 collapses. In the locked, brake active position (FIG. 2B), the actuator assembly 60 rotates the first castellation member 70 relative to the second castellation member 72 so the first and second teeth 100, 104 are aligned such that the second castellation member 72 is locked with the first castellation member 70 and engine braking is activated.

Figure 4:
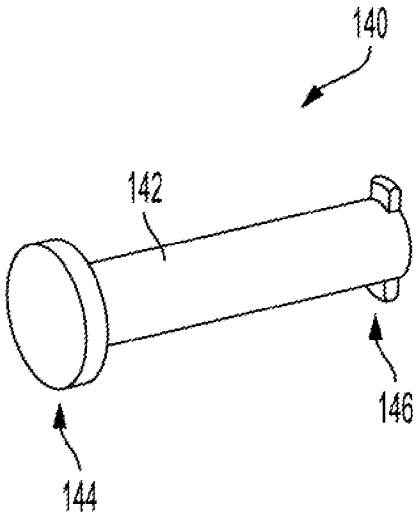
FIG. 4 is a perspective view of an example lash setting tool configured to selectively engage the actuator pin of FIG. 3.
Figure 3:
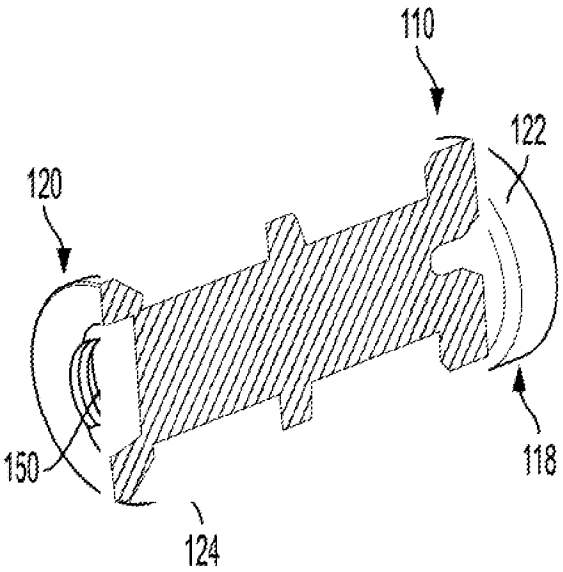
FIG. 3 is a perspective view of an example actuator pin of the actuator assembly shown in FIG. 2A.

With reference now to FIGS. 3-5, actuator assembly 60 is operably associated with a lash setting tool 140 configured to set the brake capsule assembly 22 in the brake ON position for mechanical lash setting. In the example embodiment, as seen in FIG. 4, the lash setting tool 140 includes a generally cylindrical body 142 having a grasping end 144 and an insertion end 146. The grasping end 144 is configured to be grasped by a user and the insertion end 146 is keyed to be inserted through an aperture 148 (FIG. 5) at the end of bore 116 and subsequently received within a complementary shaped recess 150 (FIG. 3) formed in an end of the actuator pin 110. In this way, the lash setting tool 140 can be inserted into recess 150 and utilized to pull the actuator pin 110 to rotate the capsule assembly 22 to the brake ON mode to set the mechanical lash on the brake rocker arm 20 without removing valve train components such as, for example, injectors (not shown).

Figure 6:
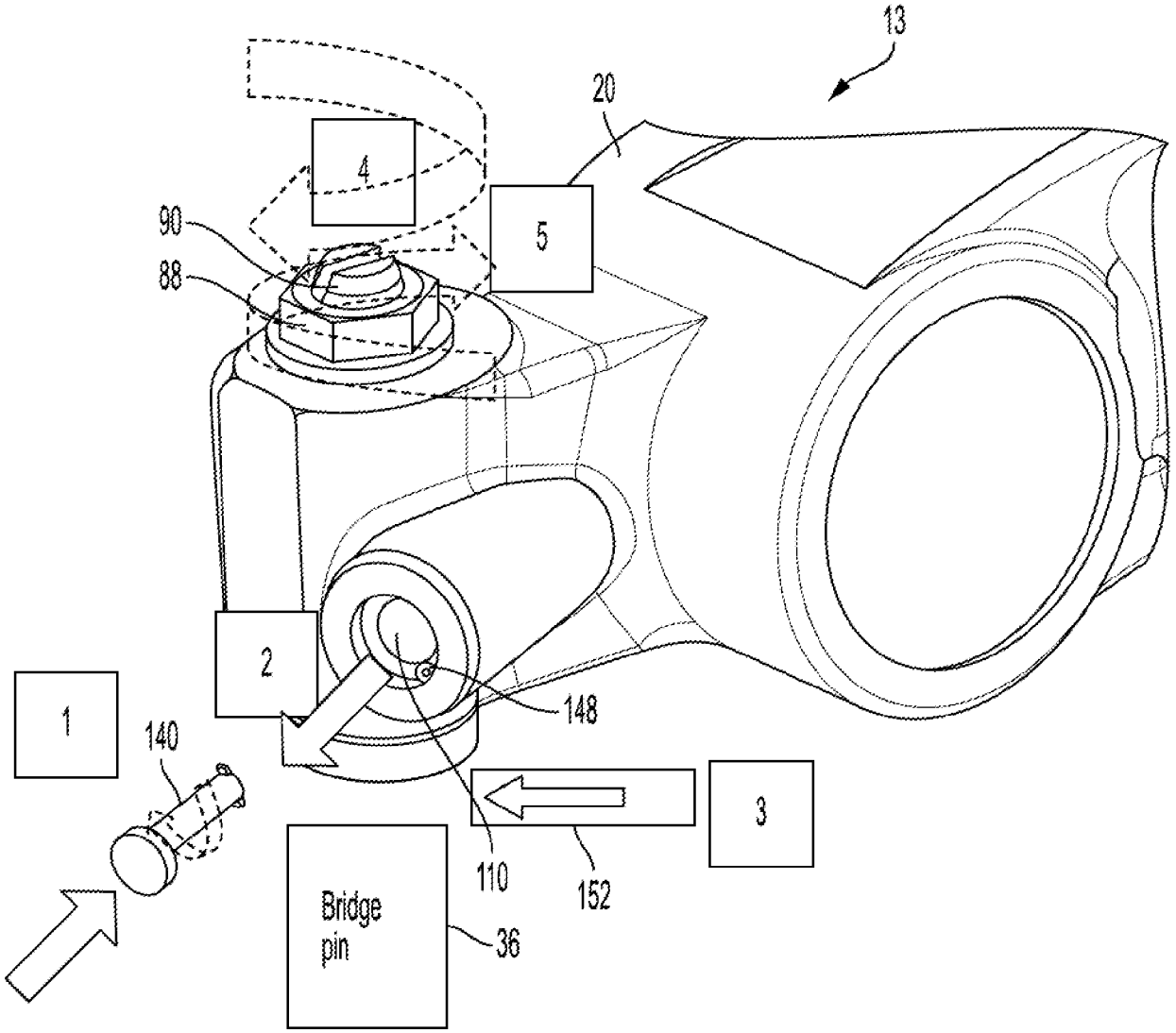
FIG. 6 is a perspective view of a portion of the exhaust rocker arm assembly of FIG. 1 during a lash setting procedure.

In one example operation, as shown in FIG. 6, the lash setting tool 140 is inserted into recess 150 and twisted to engage the actuator pin 110. The lash setting tool 140 is then pulled, thereby pulling the actuator pin 110 to move the brake capsule assembly to the braking mode ON position. A wedge fork (not shown) is utilized to hold the actuator pin 110 in the pulled position, and a shim 152 is subsequently inserted between the e-foot and bridge pin 36. The lash adjustment screw 82 is turned to close the lash at the brake capsule assembly 22 and bridge pin 36. The lash nut 88 is then turned to lock the lash adjustment screw 82 in place. Accordingly, the design enables setting of lash on the brake arm without removing valvetrain components.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An engine brake rocker arm assembly for a valvetrain and operable in an engine drive mode and an engine braking mode, the engine brake rocker arm assembly configured to selectively open one of first and second exhaust valves in the engine braking mode and comprising:

a brake rocker arm configured to rotate about a rocker shaft;

an engine brake capsule assembly movable between (i) a locked position configured to perform an engine braking operation, and (ii) an unlocked position that does not perform the engine braking operation;

an actuator assembly configured to selectively move the engine brake capsule assembly between the first and second positions; and a lash setting tool configured to removably engage the engine brake capsule assembly and move the engine brake capsule to the locked position to enable mechanical lash adjustment while the brake rocker arm is assembled in a valvetrain and the engine brake capsule is assembled in the brake rocker arm.

2. The engine brake rocker arm assembly of claim 1, wherein the lash setting tool is configured to be inserted into a bore formed in the brake rocker arm to engage the engine brake capsule.

3. The engine brake rocker arm assembly of claim 2, wherein the lash setting tool includes a cylindrical body having a grasping end and a keyed insertion end.

4. The engine brake rocker arm assembly of claim 3, wherein the keyed insertion end is keyed to an actuator pin such that the keyed end is configured to be inserted into a recess formed in an end of the actuator pin, turned, and then pulled to thereby pull the actuator pin to cause the engine brake capsule assembly to move to the locked position to enable the mechanical lash adjustment.

5. The engine brake rocker arm assembly of claim 1, wherein the engine brake capsule assembly comprises a first castellation member, a second castellation member, and a castellation biasing member that biases the first and second castellation members apart.

6. The engine brake rocker arm assembly of claim 5, wherein the first castellation member comprises a series of first teeth and first valleys, and wherein the second castellation member comprises a series of second teeth and second valleys.

7. The engine brake rocker arm assembly of claim 6, wherein the first teeth and second teeth have the same width.

8. The engine brake rocker arm assembly of claim 6, wherein the first series of teeth oppose the second series of teeth in the locked position during the engine brake mode, and wherein the second series of teeth align with the first valleys in the unlocked position during the engine drive mode.

9. The engine brake rocker arm assembly of claim 8, wherein the first castellation member rotates relative to the second castellation member when moving from the unlocked position to the locked position.

10. The engine brake rocker arm assembly of claim 8, wherein the first and second castellation members are configured to collapse toward each other during the unlocked position.

11. The engine brake rocker arm assembly of claim 1, wherein the actuator assembly comprises an actuator pin slidingly disposed within a bore formed in the brake rocker arm, wherein a hydraulic chamber is defined in the bore adjacent the actuator pin.

12. The engine brake rocker arm assembly of claim 11, wherein the hydraulic chamber is fluidly coupled to a source of hydraulic fluid to selectively move the actuator pin between a first position that corresponds to the engine brake capsule assembly locked position, and a second position that corresponds to the engine brake capsule assembly unlocked position.

13. The engine brake rocker arm assembly of claim 11, wherein the actuator assembly further comprises a retainer disposed in one end of the bore, and the actuator pin extends at least partially through the retainer.

14. The engine brake rocker arm assembly of claim 11, wherein the actuator pin includes a first seal, a second seal, and an annular flange, wherein the annular flange is configured to be received within a slot formed in the engine brake capsule assembly, wherein translation of the actuator pin in the bore translates the annular flange to thereby rotate a first castellation member of the engine brake capsule assembly.

15. The engine brake rocker arm assembly of claim 1, wherein the engine brake capsule assembly is disposed within a bore formed in the brake rocker arm and comprises:

a retainer;

a lash adjustment screw;

a first castellation member;

a second castellation member operatively associated with the first castellation member;

a castellation shaft extending through the retainer, the lash adjustment screw, and the first and second castellation members; and a castellation biasing mechanism disposed between the first and second castellation members and configured to bias the first and second castellation members apart.

16. The engine brake rocker arm assembly of claim 15, wherein the engine brake capsule assembly further comprises a castellation nut coupled to the lash adjustment screw, and wherein the castellation shaft is configured to slide within the lash adjustment screw.

17. A valvetrain assembly comprising:

a first engine valve;

a second engine valve;

a valve bridge operatively associated with the first and second engine valves; and an engine brake rocker arm assembly comprising:

a brake rocker arm configured to rotate about a rocker shaft;

an engine brake capsule assembly movable between (i) a locked position configured to open one of the first and second engine valves and perform an engine braking operation, and (ii) an unlocked position that does not perform the engine braking operation;

an actuator assembly configured to selectively move the engine brake capsule assembly between the first and second positions; and a lash setting tool configured to removably engage the engine brake capsule assembly and move the engine brake capsule to the locked position to enable mechanical lash adjustment while the brake rocker arm is assembled in a valvetrain and the engine brake capsule is assembled in the brake rocker arm.

18. The valvetrain assembly of claim 17, further comprising an exhaust rocker arm assembly having an exhaust rocker arm configured to rotate about the rocker shaft and selectively engage the valve bridge to open the first and second engine valves.

19. The valvetrain assembly of claim 18, wherein the lash setting tool is configured to be inserted into a bore formed in the brake rocker arm to engage the engine brake capsule.

20. The valvetrain assembly of claim 19, wherein the lash setting tool includes a cylindrical body having a grasping end and a keyed insertion end.

* * * * *